US005806107A

United States Patent [19]

Tilton et al.

[11] Patent Number: 5,806,107

[45] Date of Patent: Sep. 15, 1998

[54] SPLATTERLESS URINAL

[75] Inventors: Roger H. Tilton; Robert Hynes, both of Seattle, Wash.

[73] Assignee: Tilton & Madison, Ltd., Seattle, Wash.

[21] Appl. No.: 869,569

[22] Filed: Jun. 5, 1997

[51] Int. Cl.[6] ..... E03D 13/00

[52] U.S. Cl. ..... 4/310; 4/301; D23/302

[58] Field of Search ..... 4/310, 301, 302, 4/303, 304, 305, 306, 307, 308, 309, 311, 144.1, 144.3; D23/295, 302

[56] References Cited

U.S. PATENT DOCUMENTS

| | | | |
|---|---|---|---|
| Re. 9,427 | 10/1880 | Smith . | |
| D. 195,617 | 7/1963 | Eger . | |
| D. 204,052 | 3/1966 | Hilde, Jr. | D4/5 |
| D. 222,062 | 9/1971 | Rutzick | D23/2 |
| D. 233,889 | 12/1974 | Juaire | D23/2 |
| D. 258,682 | 3/1981 | Wilson | D23/302 |
| D. 281,270 | 11/1985 | Doman | D23/68 |
| 293,275 | 2/1884 | Pullman . | |
| D. 352,349 | 11/1994 | Kergoet et al. | D23/302 |
| D. 354,122 | 1/1995 | Carlier | D23/302 |
| 602,080 | 4/1898 | Hutchinson | 4/311 |
| 650,897 | 6/1900 | Hinsdale . | |
| 654,601 | 7/1900 | Bunting, Jr. . | |
| 705,319 | 7/1902 | Bush . | |
| 1,114,670 | 10/1914 | Baker . | |
| 1,441,007 | 1/1923 | Littlefield . | |
| 2,182,979 | 12/1939 | Bruzenak . | |
| 2,310,658 | 2/1943 | Strite et al. . | |
| 2,703,409 | 3/1955 | Manning et al. . | |
| 3,251,070 | 5/1966 | Blakenship . | |
| 3,742,522 | 7/1973 | Stevenson | 4/10 |
| 3,751,736 | 8/1973 | Egli | 4/100 |
| 4,145,768 | 3/1979 | Chevrette | 4/144.1 |
| 4,494,581 | 1/1985 | Gordon | 141/1 |
| 5,027,448 | 7/1991 | Wilkins | 4/310 |
| 5,134,728 | 8/1992 | Sturm | 4/307 |
| 5,390,374 | 2/1995 | Hubrig et al. | 4/301 |

*Primary Examiner*—David J. Walczak
*Attorney, Agent, or Firm*—Bazerman & Drangel, P.C.

[57] ABSTRACT

A splatterless urinal having a chamber for the reception of urine in the form of a truncated right circular cone. One side of the cone shaped interior chamber is positioned vertically so that the base of the cone is at an angle to the vertical, whereby the incoming urine stream is captured and retained within the body of the urinal.

5 Claims, 3 Drawing Sheets

FIG. 1
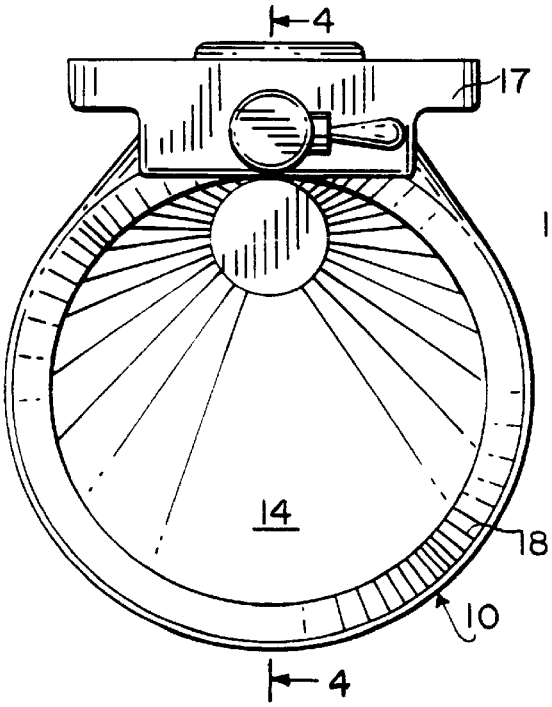
FIG. 2
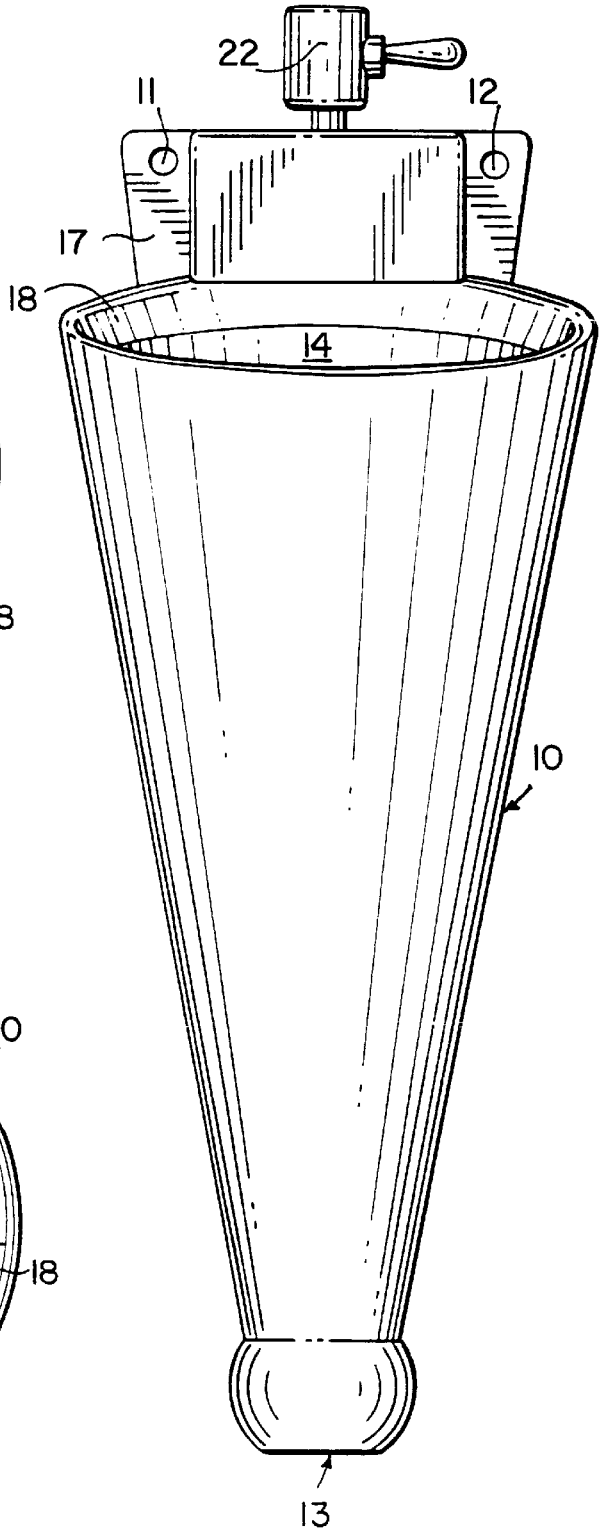
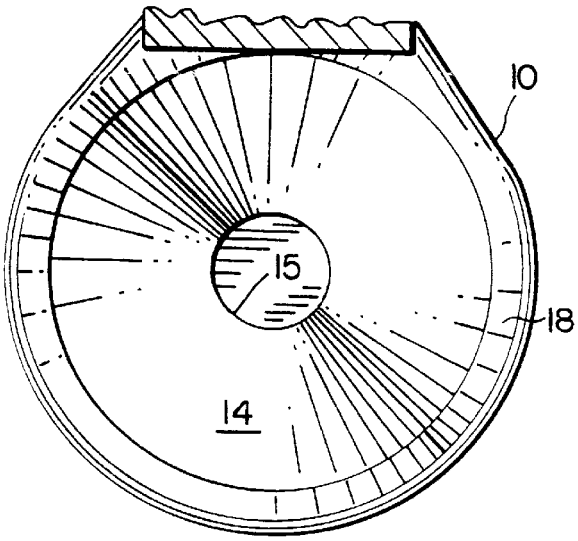
FIG. 6

SPLATTERLESS URINAL

FIELD OF THE INVENTION

The present invention relates to a plumbing fixture and more particularly relates to a urinal designed to virtually eliminate splattering of urine and/or water outside the confines of the urinal structure.

BACKGROUND OF THE INVENTION

There are a large number of designs for conventional urinals for use by males presently available. They are either floor or wall mounted having a large, open concave cavity for the reception of urine. Such general designs conventionally have a flat or slightly concave urinal surface. Typical designs are found in U.S. Design Pat. Des. 352,349, issued Nov. 8, 1994, entitled URINAL; Des. 281,270, issued Nov. 5, 1985, entitled URINAL; Des. 233,889, issued Dec. 10, 1974, entitled URINAL FOR PORTABLE TOILET BUILDING; Des. 222,062, issued Sep. 28, 1971, entitled URINAL; Des. 204,052, issued Mar. 15, 1966, entitled URINAL; Des. 195,617, issued Jul. 9, 1963, entitled WALL MOUNTED URINAL; and Re. 9,427, reissued Oct. 18, 1880, entitled URINAL; U.S. Pat. No. 293,275, issued Feb. 12, 1884, entitled URINAL; and U.S. Pat. No. 1,114,670, issued Oct. 20, 1914, entitled URINAL.

Such designs are meant for use by men who stand at a distance from the urinal. As a natural consequence of such designs, there is a splattering of the urine streams due both to the geometry of the wall which is the natural target of the urine stream and because conventional urinals do not have adequate means to confine the urine to the flushed area within the urinal. The resulting splattering produces unclean, unsanitary conditions in and around the urinal area and on the body or clothing of the urinator.

While there have been a few designs for female or combined male/female urinals, such as U.S. Pat. No. 2,310,658 (full information) and U.S. Pat. No. 5,390,374, issued Feb. 21, 1995, entitled WATER CONSERVING URINAL, splattering outside the urinal is peculiar to urinals designed due to the anatomical differences between the sexes and the resulting difference in urinal structure and method of use.

U.S. Pat. No. 1,114,670 to Baker attempts to face this problem by forming a urinal with partially enclosing sides defining an elongated longitudinal opening having interior flanges 2 expanding around the opening to catch splatter. Such a structure is complicated in design and, thus, complicated to manufacture. It also takes up a considerable amount of floor area and finally, would itself be conductive to splattering to the extent that the urinal stream misses the slender opening provided for it.

SUMMARY OF THE INVENTION

Accordingly, it is a broad object of the present invention to provide a splatter minimizing urinal assembly which is of simple construction and ease of use.

Such ends are met through the configuration of the urinal of the present invention. The urinal's basic structure includes an interior chamber in the form of an upside-down truncated circular cone having one side of the cone vertically positioned so that the cone is cast forward at an angle to the wall. The truncated bottom surface of the cone opens into a catch basin and trap. In flushing, water is circulated throughout the interior structure through openings around the outer rim of the upper surface of the cone. This rinses the entire basin. All areas where urine could contact the urinal surface will thereby be cleansed. Since the interior shape of the urinal is conical, the flush water is concentrated as it descends along the length of the urinal. This allows a low-flow flush with a flow rate of less than one (1) gallon for a full flush with a complete cleansing of the urinal.

Due both to the enclosed vertical nature of this structure and the angles formed by its walls, the urine stream is confined upon entering the basin such that any splattering which may occur is directed back into the basin, harmlessly splattering against the urinal walls of the basin.

BRIEF DESCRIPTION OF THE DRAWINGS

The invention will be described by way of example with reference to the accompanying drawings wherein:

FIG. 1 is a top view of the urinal of the present invention;

FIG. 2 is a front view of the urinal of the present invention;

FIG. 6 is a partial cross-sectional view taken on line 6—6 of FIG. 4.

DETAILED DESCRIPTION OF THE PREFERRED EMBODIMENT

Figure 3:
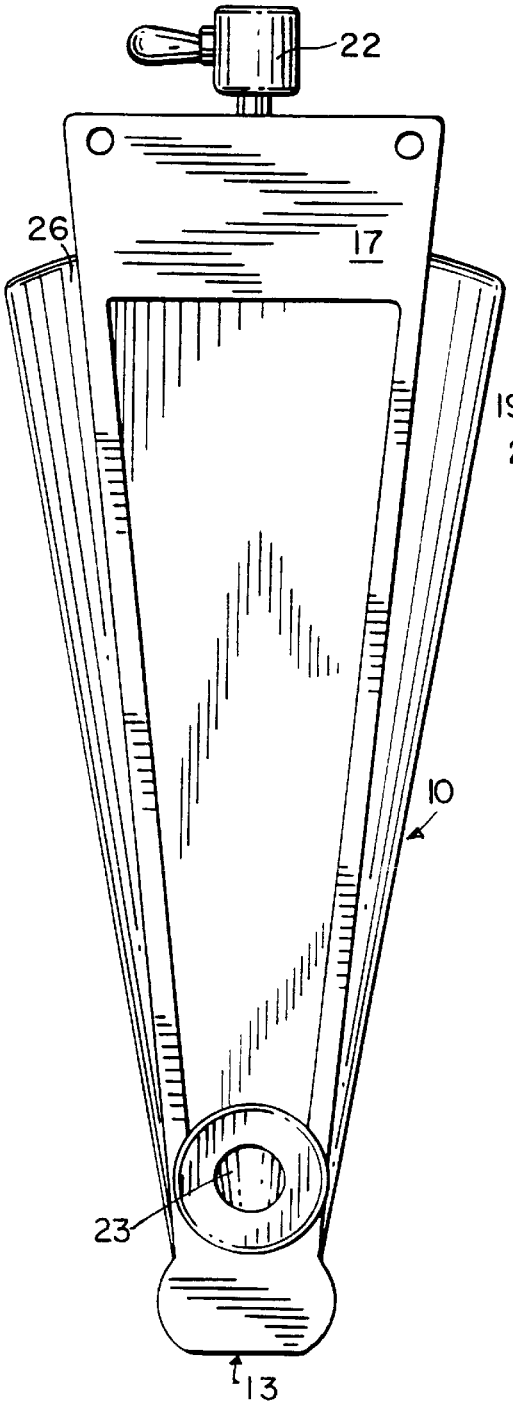
FIG. 3 is a back view of the urinal of the present invention.
Figure 4:
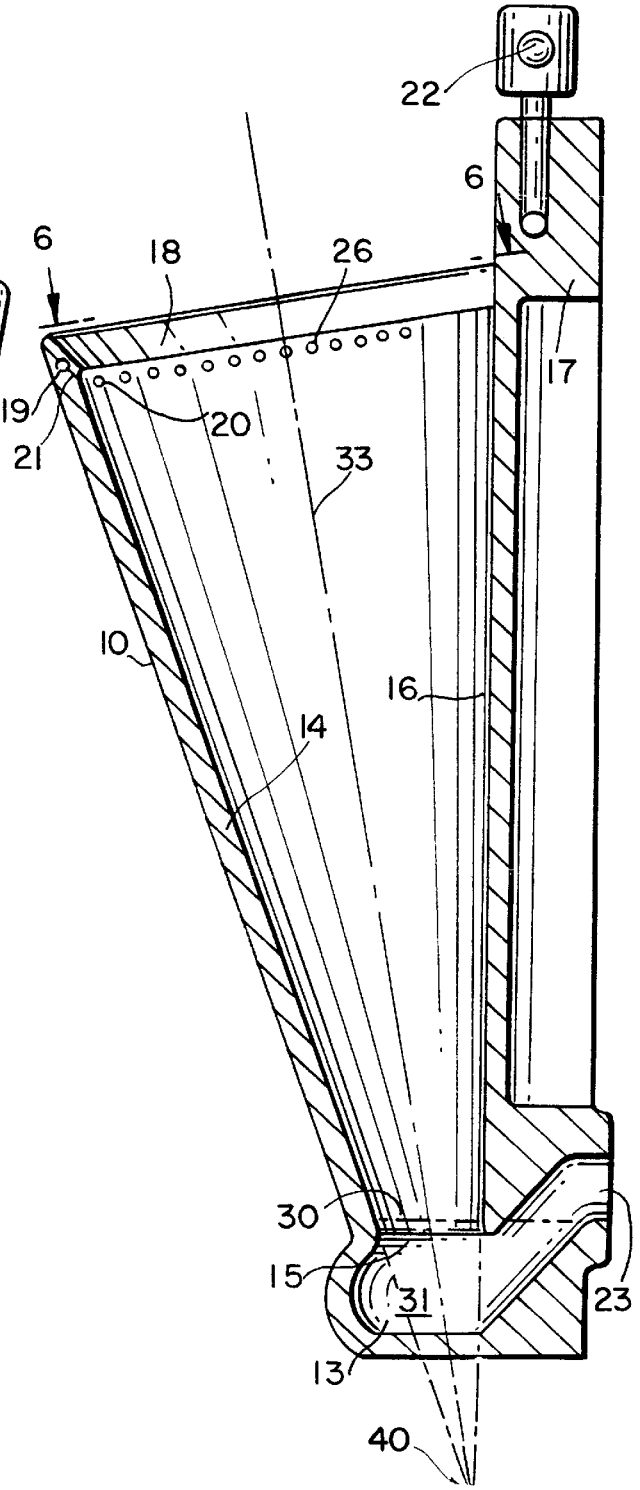
FIG. 4 is a partial cross-sectional view taken on line 4—4 of FIG. 1.
Figure 5:
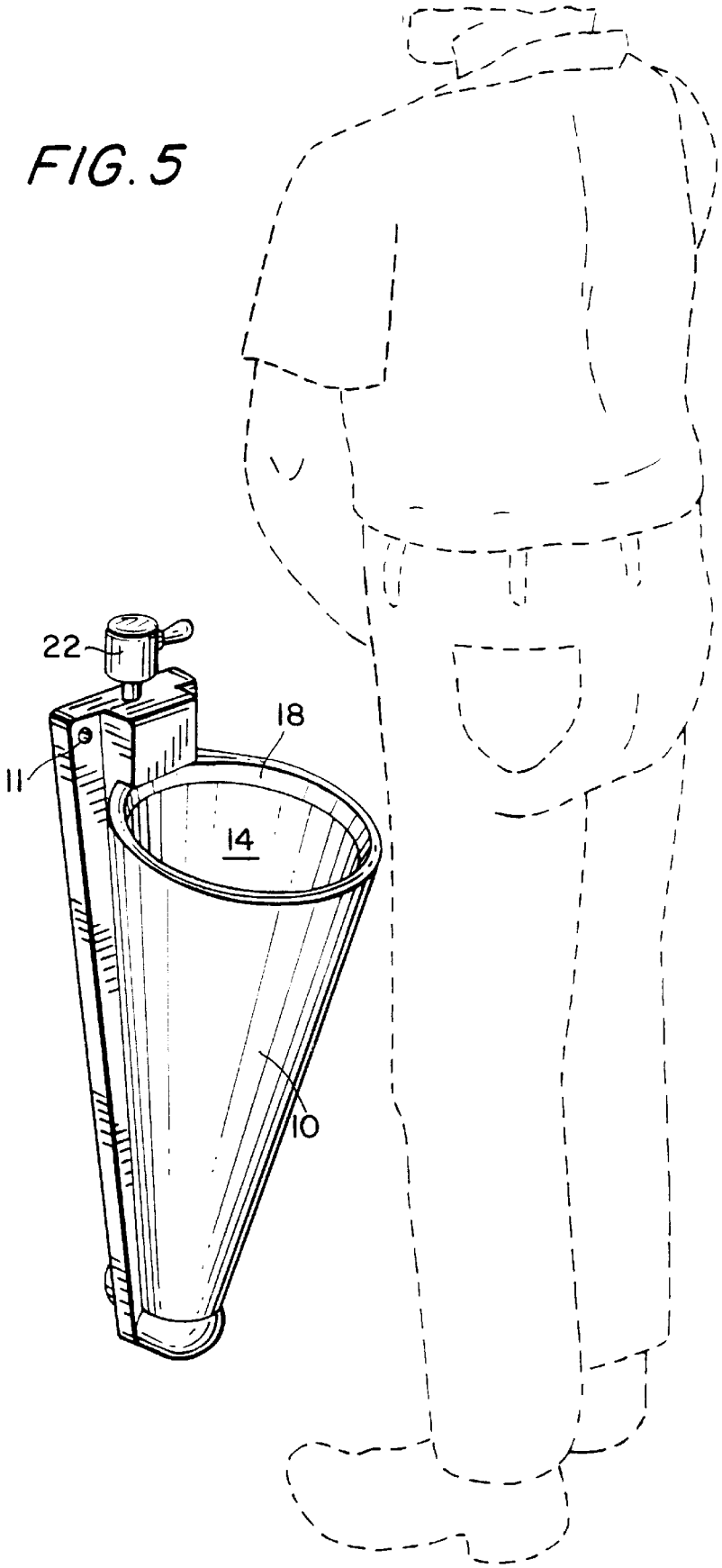
FIG. 5 is a perspective view of the urinal in use with the user shown in dotted lines.

Turning now to the drawings, FIGS. 1 through 5 show the preferred embodiment of the present invention which is generally designated by the numeral 10. The urinal 10 is designed to be wall mounted by conventional means such as bolts positioned through openings 11 and 12. Urinal 10 may have its bottom 13 in contact with the floor of the restroom or its bottom 13 may be positioned above the floor of a restroom. The surface of the interior chamber 14 of the urinal 10 which catches the urine is in the form of an upside-down, right-circular, conical section which is truncated at plane 15 having a base 26 and a vertex 40. This allows the interior chamber 14 to be in communication with catch basin 31 at plane 15 and with trap 25 through catch basin 31. The axis 33 of the conical surface forming interior chamber 14 is at right angles to base 26 and is at an oblique angle to truncated plane 15. When mounting surface 17 is vertically mounted on a wall, a straight line 16 can be made on the conical surface defining the interior chamber 14 between the base 26 and the vertex 40 which will also be positioned vertically. This cants the urinal body 14 forward at an angle to the mounting surface 17 and, thus, at an angle to the wall on which it is mounted. The base 26 of the conical-shaped interior chamber 14 is at an angle to the mounting surface 17 thereby presenting a large angled opening for entry of the urine stream. In use, the urine stream would be in a downward direction.

On top of the base 26 is a lip 18 having a passage 19 through which water can flow when the urinal is to be flushed. Openings 20 are positioned around the underside of rim 18 and are connected to passage 19 by means of individual connecting passages 21. Passages 19 and openings 20 are angled in such a way as to create a circular stream of water around and down through the interior of the cone 14. The end of passage 19 is connected to a conventional flushometer 22. During flushing, the angled openings 20 create a circular motion of the water which, when combined with the unique, conical interior inner surface, acts to sweep clean the interior of the urinal while conserving the amount of water necessary for a proper cleansing. Since the design is conical, the amount of flush water per square inch of surface area increases as the water descends down the cone 14, corresponding to the increased presence of urine. Substantially less than one (1) gallon of water per flush is all that is necessary to completely cleans the urinal of the present invention. This more than meets the current low-flow flush standard which has been established by the American National Standard Institute (ANSI) and is required by many states.

Since the catch basin 31 meets the interior chamber 14 at an angle, their intersection forms an oval at plane 15 having very close minor axis so that it appears circular as can be seen in FIGS. 1 and 6. The catch basin 31 has a conduit 23 for connection to a waste disposal line. Conduit 23 is inclined forward to form a waste trap 25 which retains a level of water 30 in the urinal body 14 sufficient to isolate the urinal 10 from the waste line to which it is attached.

In use, the design of this urinal forces the user to position the stream of urine at a downward angle in order to be received in the conical body 14. Any splattering which occurs would be retained in the body 14. When flushed, water is supplied about the rim 18 of the body 14. The water completely flushes the interior chamber 14. The urine and water are collected in catch basin 31 and then flushed out through conduit 23 leaving a fresh layer of water in the catch basin 31. The flush water would be retained in the body. The body 14 may be made of varying height to accommodate both children and adults.

It is understood that the present embodiment described above is to be considered as illustrative and not restrictive. It will be obvious to those skilled in the art to make various changes, alterations and modifications to the invention described herein. To the extent that these variations, modifications and alterations depart from the scope and spirit of the appended claims, they are intended to be encompassed therein.

We claim:

1. A urinal adapted to be mounted on a vertical wall and having an interior chamber for the reception of urine in the form of a truncated circular cone having a base at an entry into the interior chamber of the urinal and a vertex in proximity to an exit out of said interior chamber whereby when said urinal is mounted to the wall one straight line on a surface of the interior chamber between the base of the cone shaped interior chamber and the vertex of the cone shaped interior chambers is positioned vertically to the surface of the earth and the base of the cone shaped interior chamber is at an angle to such vertical.

2. A urinal in accordance with claim 1 wherein the interior chamber is in the form of a truncated right circular cone.

3. A urinal in accordance with claim 2 wherein the truncated end of the cone shaped interior chamber of the urinal forms the entrance to a chamber and trap.

4. A urinal in accordance with claim 2 in which flush water is introduced through a passageway around the base of the cone forming the interior chamber of the urinal.

5. A urinal in accordance with claim 4 wherein there are openings in said passageway to allow water to enter the cone for the purpose of flushing the cone, said openings being angled so as to cause the flush water passing through the openings to swirl around the canted interior chamber of the urinal.

* * * * *